US010035575B2

(12) United States Patent
Bernloehr et al.

(10) Patent No.: US 10,035,575 B2
(45) Date of Patent: Jul. 31, 2018

(54) TROLLING MOTOR SYSTEM WITH LIFT ASSIST DEVICE

(71) Applicants: Darrel A. Bernloehr, Mankato, MN (US); Craig E. Turek, Good Thunder, MN (US)

(72) Inventors: Darrel A. Bernloehr, Mankato, MN (US); Craig E. Turek, Good Thunder, MN (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 15/402,894

(22) Filed: Jan. 10, 2017

(65) Prior Publication Data

US 2017/0210455 A1 Jul. 27, 2017

Related U.S. Application Data

(60) Provisional application No. 62/281,580, filed on Jan. 21, 2016.

(51) Int. Cl.

| | |
|---|---|
| ***B63H 5/20*** | (2006.01) |
| ***B63H 5/125*** | (2006.01) |
| ***B63H 20/08*** | (2006.01) |
| ***B63H 20/10*** | (2006.01) |
| ***B63H 20/00*** | (2006.01) |
| ***B63H 20/06*** | (2006.01) |
| ***B63H 20/12*** | (2006.01) |
| *B63H 21/17* | (2006.01) |

(52) U.S. Cl.
CPC ..... *B63H 20/106* (2013.01); *B63H 20/007* (2013.01); *B63H 20/06* (2013.01); *B63H 20/12* (2013.01)

(58) Field of Classification Search
CPC ..... B63H 20/00; B63H 20/007; B63H 20/02; B63H 20/06; B63H 20/08; B63H 20/10; B63H 20/106; B63H 20/12; B63H 20/14; B63H 2020/00; B63H 2020/02; B63H 2020/08; B63H 2020/10; B63H 2020/103; B63H 2020/14; B63H 2020/145
USPC ..... 440/53, 55, 56, 57, 61 S, 61 T, 61 E, 62, 440/63, 64, 65, 6
See application file for complete search history.

(56) References Cited

U.S. PATENT DOCUMENTS

| | | | | |
|---|---|---|---|---|
| 4,634,390 A * | 1/1987 | Baird | ..... | B63H 20/007 248/642 |
| 4,966,566 A * | 10/1990 | Baird | ..... | B63H 20/007 248/642 |
| 5,112,258 A * | 5/1992 | Folsom | ..... | B63H 20/007 440/6 |
| 7,722,417 B2 | 5/2010 | Bernloehr et al. | | |

* cited by examiner

*Primary Examiner* — Daniel V Venne
(74) *Attorney, Agent, or Firm* — Reinhart Boerner Van Deuren P.C.

(57) ABSTRACT

A trolling motor system with a lift assist device is provided. The trolling motor system includes a lift assist device which aids in moving a shaft assembly of the trolling motor system along a trim axis thereof. The lift assist device includes a biasing element which extends therefrom and connects to a shaft assembly of the trolling motor system.

12 Claims, 6 Drawing Sheets

TROLLING MOTOR SYSTEM WITH LIFT ASSIST DEVICE

CROSS-REFERENCE TO RELATED PATENT APPLICATION

This patent application claims the benefit of U.S. Provisional Patent Application No. 62/281,580, filed Jan. 21, 2016, the entire teachings and disclosure of which are incorporated herein by reference thereto.

FIELD OF THE INVENTION

This invention generally relates to watercraft equipment, and more particularly to trolling motors.

BACKGROUND OF THE INVENTION

Fishing boats and other vessels are often equipped with a trolling motor for providing a relatively small amount of thrust to slowly and quietly propel the boat or vessel. They advantageously provide for a finer adjustment of watercraft position than a main motor/propeller combination. One example of a contemporary trolling motor system may be found at U.S. Pat. No. 7,722,417 to Bernloehr et al. titled Trolling Motor Mount with Mono Main Arm, the entire teachings and disclosure of which are incorporated by reference herein.

As is readily understood in the art, such trolling motors incorporate a shaft with a propulsion unit at one end thereof. In a deployed position, the shaft is partially submerged in the water to situate the propulsion unit at a desired depth to provide thrust. To place the trolling motor in a stowed position, the shaft is pulled upwardly out of the water, and then rotated about a pivot point to secure it such that it is generally parallel relative to the surface of the water. While there are some designs which include an automated stow-deploy mechanism, many contemporary trolling motors are manually placed from the stowed position to the deployed position and vice versa.

In recent years, there has been a growing design trend in using larger motors in the propulsion unit to drive a propeller thereof. Such larger motors advantageously allow for a larger spectrum of applications of the trolling motor. In some cases, an ordinarily required outboard motor may be omitted entirely if the sizing of the motor on the trolling motor is sufficient enough to provide the required thrust. In other words, the larger more powerful motor of the trolling motor allows one to utilize only that device for propulsion of their watercraft, as opposed to a main outboard unit and a trolling motor.

Unfortunately, as a result of such larger motors, the overall weight of the trolling motor has significantly increased. This increase in weight has led to user difficulty in manually transitioning the trolling motor from the deployed position back to the stowed position. Indeed, the increased weight of the propulsion unit makes it difficult for a user to pull upwardly on the shaft to draw the shaft and the propulsion unit out of the water as there is a significant increase in the pulling force required. Such a weight increase is particularly problematic for younger or elderly users, as well as for those users which may have a persistent back injury limiting the amount of weight they can lift upwardly.

As such, there is a need in the art for a trolling motor system which, despite having a relatively large propulsion unit, may still be readily lifted out of the water to stow the same. There is also a need in the art for a lift assist device which may be retrofit onto an existing trolling motor with a relatively large propulsion unit so that it too may be readily lifted out of the water.

The invention provides such a system and device. These and other advantages of the invention, as well as additional inventive features, will be apparent from the description of the invention provided herein.

BRIEF SUMMARY OF THE INVENTION

In one aspect, a trolling motor system with a lift assist device is provided. An embodiment of such a trolling motor system includes a mount for mounting the trolling motor system to a watercraft. A steering module is mounted to the mount. The trolling motor system also includes a shaft assembly which includes a shaft, a head unit mounted to a first end of the shaft, and a propeller unit mounted to a second end of the shaft. The shaft extends through a steering collar of the steering module. The shaft assembly is linearly movable relative to the steering module along a trim axis. The trolling motor system also includes a lift assist device. The lift assist device is selectively coupled to the steering collar such that in a coupled position, a rotational torque acting upon the steering collar is transferred to the lift assist device, and in a decoupled position the shaft assembly and lift assist device are rotatable relative to the steering collar. The lift assist device is operably coupled to the shaft assembly to exert an upward pulling force against the shaft assembly along the trim axis.

The shaft assembly includes a stop collar mounted along the shaft. The lift assist device includes an engagement member. The stop collar biases an engaging end of the engagement member out of a housing of the lift assist device in the coupled position.

The engaging end of the engagement member seats in a receiving gap of the steering collar in the coupled position such that the rotational torque acting upon the steering collar is transferred to the engagement member of the lift assist device. The lift assist device also includes a guide member. The guide member includes a projection. The projection of the guide member seats in a channel of the shaft of the shaft assembly.

The lift assist device includes a biasing element which is extendable from a housing of the lift assist device. In one embodiment, the biasing element is a coil spring. An end of the coil spring is connected to the shaft assembly by a mounting collar. The mounting collar is mounted to the propeller unit of the shaft assembly.

In another aspect, a lift assist device for a trolling motor is provided which advantageously may be retrofit onto an existing trolling motor. Such a lift assist device includes a housing defining an opening configured for receipt of a shaft assembly of a trolling motor such that the shaft assembly is linearly movable within the opening along a trim axis. The lift assist device also includes a biasing element mounted within the housing. The biasing element is extendable from the housing. The biasing element has an end thereof configured for connection to the shaft assembly. The biasing element is configured to exert an upward force upon the shaft assembly along the trim axis.

In one embodiment, the biasing element is a coil spring. The coil spring is uncoilable through an opening in the housing. The lift assist device also includes a guide bar for guiding the coil spring through the opening in the housing. The guide bar includes a projection. The projection is configured to seat in a channel of the shaft assembly.

The lift assist device also includes an engagement member contained within the housing. A spring contained within the housing acts upon the engagement member such that the spring biases an engaging end of the engagement member into a recessed position within the housing. The engaging end of the engagement member is configured to protrude from the housing against a biasing force of the spring and is arranged to extend into a receiving gap of a steering collar of the trolling motor.

In another aspect, a trolling motor system is provided which advantageously reduces the amount of upward pulling force necessary to place a trolling motor into a stowed position. Such a trolling motor system includes a mount, a steering module mounted to the mount, a shaft assembly received by the steering module and movable along a trim axis relative to the steering module, and a lift assist device. The lift assist device is operably coupled to the shaft assembly to exert an upward point force against the shaft assembly along the trim axis.

The lift assist device is operably coupled to the shaft assembly by a biasing element. The lift assist device also includes an engagement member for selectively rotationally coupling and rotationally decoupling the lift assist device from a steering collar of the steering module.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
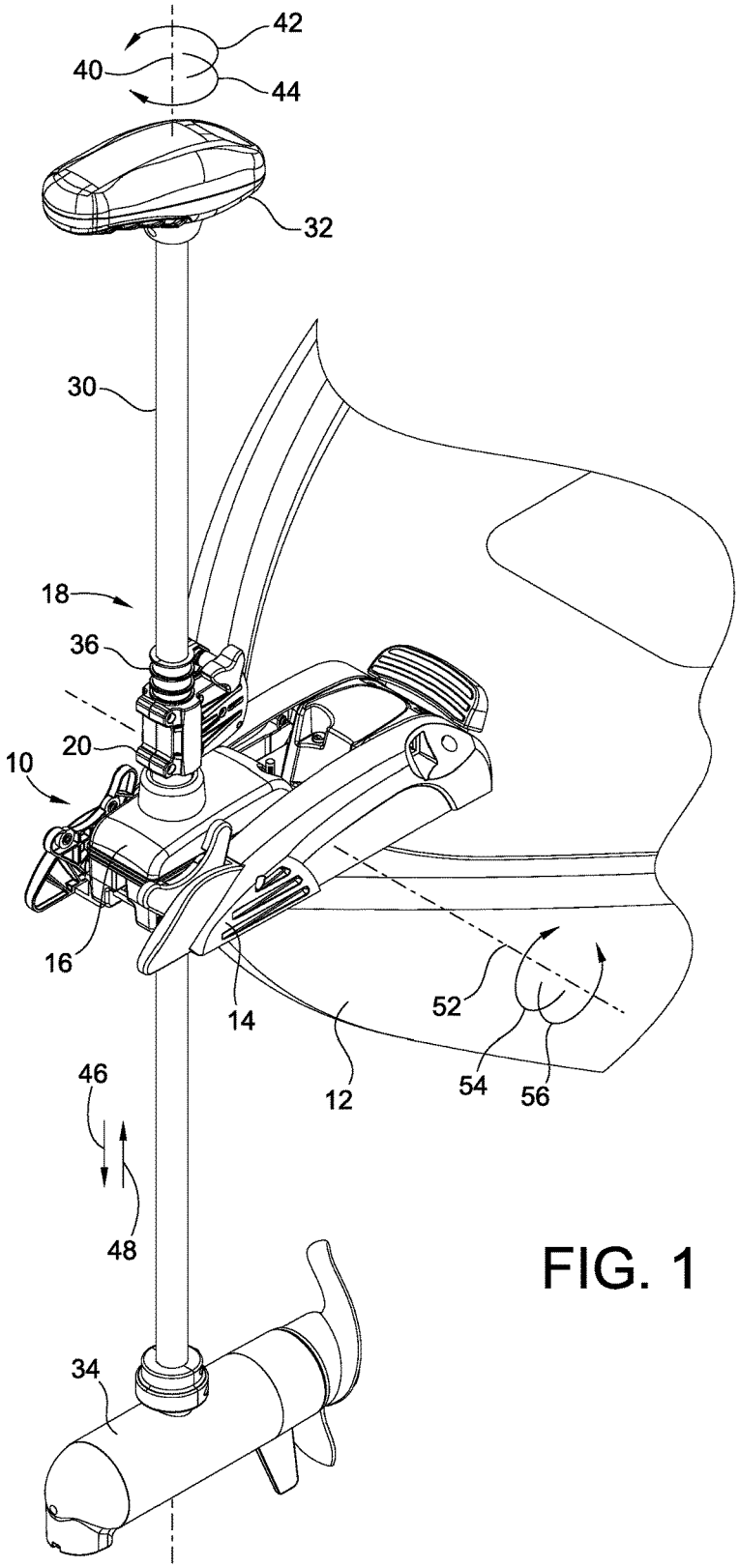
FIG. 1 is a perspective view of one embodiment of a trolling motor system according to the teachings of the present invention mounted to a watercraft in a deployed position.
Figure 2:
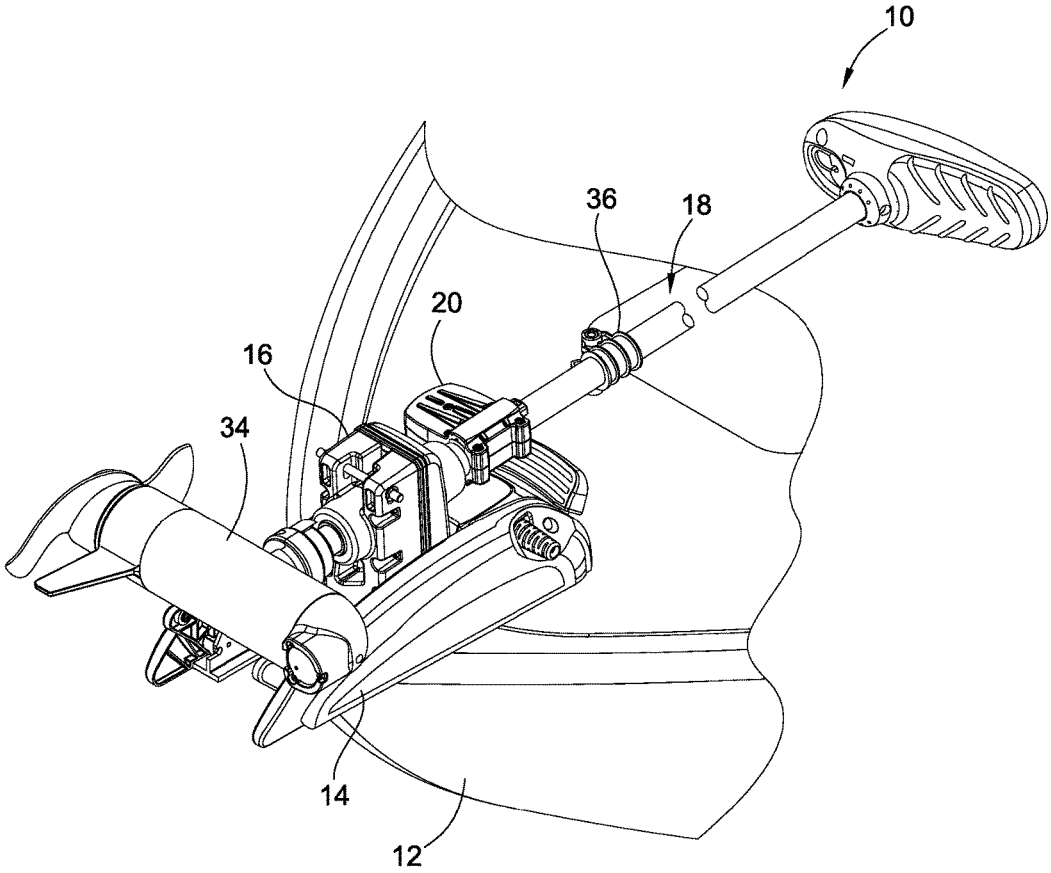
FIG. 2 is a perspective view of the trolling motor system of FIG. 1 in a stowed position.

Turning now to the drawings, an embodiment of a trolling motor system 10 is illustrated therein which advantageously provides a lift assist device 20 for reducing the overall pulling force required to transition trolling motor system 10 from a deployed position as shown in FIG. 1, to a stowed position as shown in FIG. 2. As will be understood from the following, this advantageously allows for the use of heavier propeller units on the trolling motor.

As can be seen in FIG. 1, trolling motor system 10 includes a mount 14 for mounting trolling motor system 10 to a watercraft 12. Trolling motor system 10 also includes a steering module 16 mounted to mount 14. A shaft assembly 18 is slidably received in steering module 16. Steering module 16 is responsible for providing steering inputs to shaft assembly 18 to rotate the same about a trim axis 40 in rotational directions 42, 44. As is understood by those of skill in the art, this rotation about trim axis 40 directs the thrust provided by shaft assembly 18. Additionally, shaft assembly 18 is linearly adjustable along trim axis 40 to adjust the trim of shaft assembly 18, i.e. the depth of the thrust provided thereby. As can be seen in FIG. 1, this trim axis 40 is coincident with the longitudinal axis of the shaft assembly. The aforementioned lift assist device 20 also slidably receives shaft assembly 18 as shown. As will explained in greater detail below, shaft assembly 18 is also linearly movable along trim axis 40 relative to lift assist device 20. However, shaft assembly 18 and lift assist device 20 are rotationally coupled to one another such that they rotate in unison about trim axis 40.

To make the above transition between the deployed position shown in FIG. 1 to the stowed position in FIG. 2, shaft assembly 18 of trolling motor system 10 must be pulled upwardly along trim axis 40 in a linear direction 48, and then shaft assembly 18 and steering module 16 must be pivoted about a pivot axis 52 in a rotational direction 54 to place the same in the stowed position. A similar operation must be done to adjust the trim of shaft assembly 18 such that the depth of thrust provided thereby is reduced, i.e. shaft assembly 18 must be moved upwardly along trim axis 40. In either case, this upward movement of shaft assembly 18 requires a significant amount of force. Advantageously, lift assist device 20 provides a reduction in the overall force input required by a user to achieve the foregoing.

Shaft assembly 18 includes an elongated shaft 30. A head unit 32 is connected to a first end of shaft 30. A propeller unit 34 is connected to a second end of shaft 30. Head unit 32 is connected through the hollow interior of shaft 30 to propeller unit 34 to provide thrust commands thereto. Additionally, steering commands may be communicated via a wired or wireless connection to head unit 32, and then communicated via a wired or wireless connection to steering module 16, ultimately to rotate shaft assembly 18 about trim axis 40 in rotational directions 42, 44. Alternatively, such steering commands may be communicated directly to steering module 16 via a wired or wireless connection. Furthermore, head unit 32 may include various automated steering control and navigation functions. Such steering commands may be communicated by a control device, which may be a stand-alone control device, or an integrated device such as a fish finder, mobile device, or the like.

Despite the above capability for automated steering and navigation of trolling motor system 10, trim adjustment, i.e. movement of shaft assembly 18 in linear directions 46, 48 along trim axis 40 is done manually. A stop collar 36 is utilized to limit the maximum linear travel of shaft assembly 18 relative to steering module 16 in linear direction 46. The abutment of propeller unit 34 with a bottom of steering module 16 limits the linear travel of shaft assembly 18 in linear direction 48.

Figure 3:
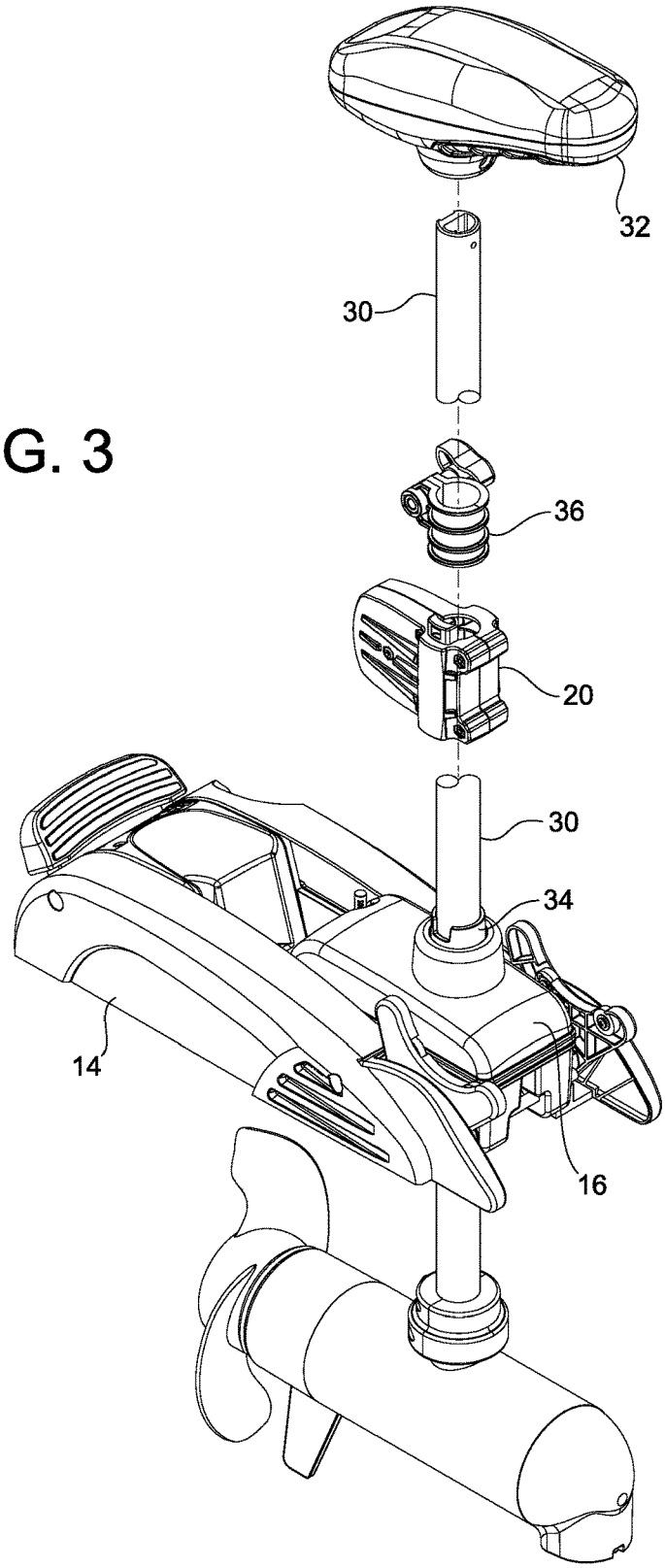
FIG. 3 is an exploded view of the trolling motor system of FIG. 1.

As can be seen in FIG. 3, lift assist device 20 is positioned between steering module 16 and stop collar 36. As will be explained in greater detail below, steering inputs from steering module 16 are not applied directly to shaft 30, but are instead applied to lift assist device 20 which in turn applies the same to shaft 30 ultimately to rotate shaft assembly 18 about trim axis 40 in rotational directions 42, 44 (See FIG. 1). Additionally, as can be seen from the exploded view of FIG. 3, lift assist device 20 includes an opening through which shaft assembly 18 extends. Put differently, lift assist device 20 may be readily installed on a shaft assembly 18 such as that shown by sliding it down along shaft 30 of the shaft assembly 18.

Figure 4:
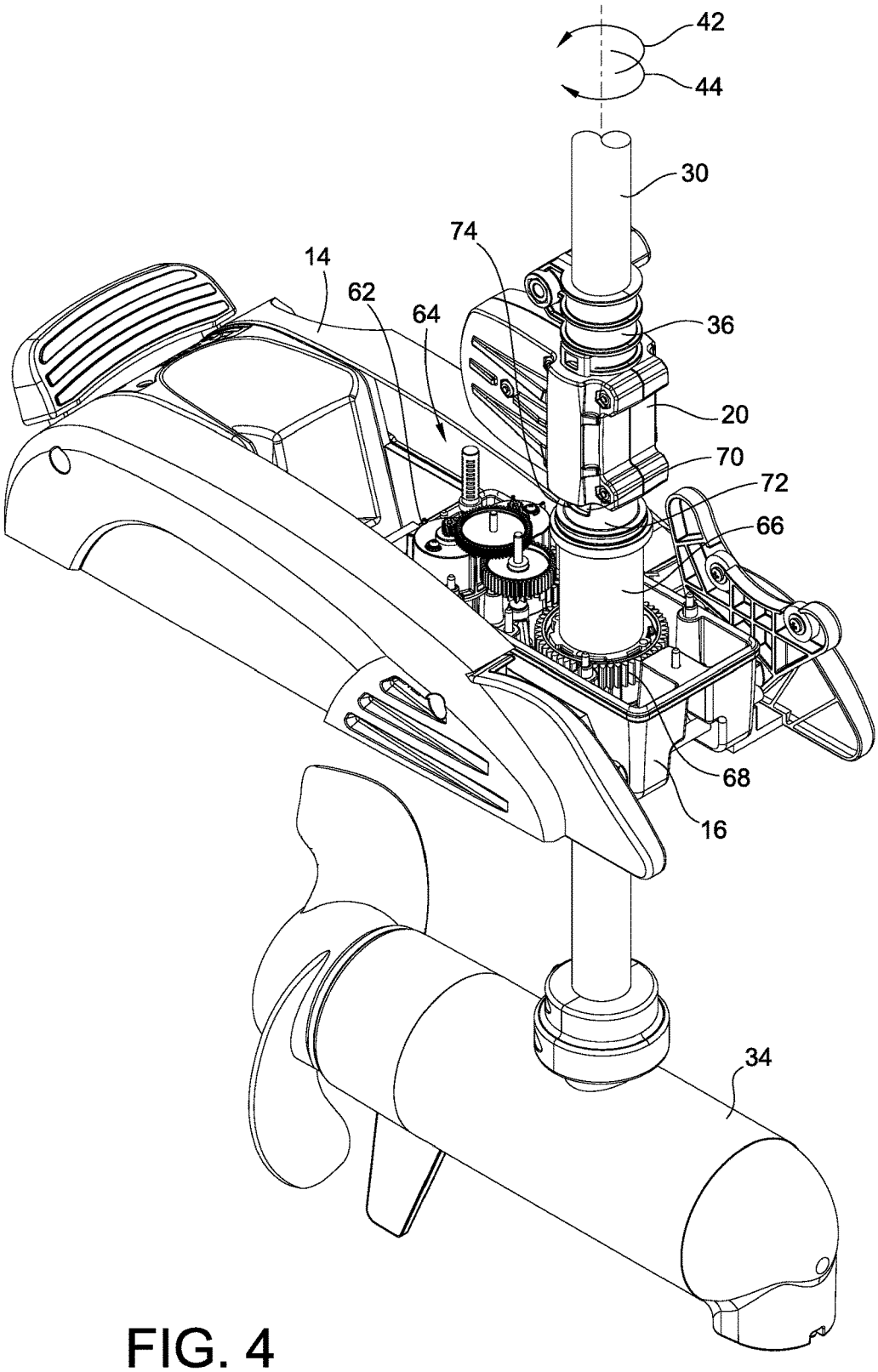
FIG. 4 is a perspective view of a steering unit of the trolling motor system of FIG. 1.

Indeed, and with reference now to FIG. 4, an upper portion of an outer housing of steering module 16 has been removed to illustrate the interior thereof. As can be seen therein, steering module 16 includes an internal motor or motors 62. This motor 62 is in meshed contact with a gear train 64. Gear train 64 is in meshed contact with a steering collar 66 through which shaft 30 of shaft assembly 18 extends. A drive gear 68 is fixedly mounted to steering collar 66 such that rotation and drive gear 68 results in a like rotation of steering collar 66. As can be seen in FIG. 4, this drive gear 68 is in meshed contact with gear train 64. Accordingly, inputs from motor 62 are communicated to steering collar 66.

Lift assist device 20 has a coupled and a decoupled configuration. The coupled configuration is illustrated in FIG. 4. In the coupled configuration, an engagement member 70 of lift assist device 20 is received within a receiving gap 72 formed in steering collar 66. Specifically, an engaging end 74 of engagement member 70 is selectively movable in and out of receiving gap 72. When engaging end 74 is received in receiving gap 72, lift assist device 20 is in its coupled configuration. When engaging end 74 is not positioned within receiving gap 72, lift assist device is in its decoupled configuration.

When in the coupled configuration, rotation of steering collar 66 results in a rotation of lift assist device 20 due to the positioning of engaging end 74 within receiving gap 72. Shaft 30 is extends through steering collar 66, but is not connected directly to steering collar 66. As a result, rotation of shaft 30 due to the rotation of steering collar 66 is made possible by lift assist device 20, when the same is in the coupled configuration.

Indeed, lift assist device 20 includes a guide member internally therein which engages shaft 30 such that shaft 30 also rotates with the rotation of lift assist device 20 and steering collar 66. This configuration ultimately causes the steering functionality of trolling motor system 10.

Figure 5:
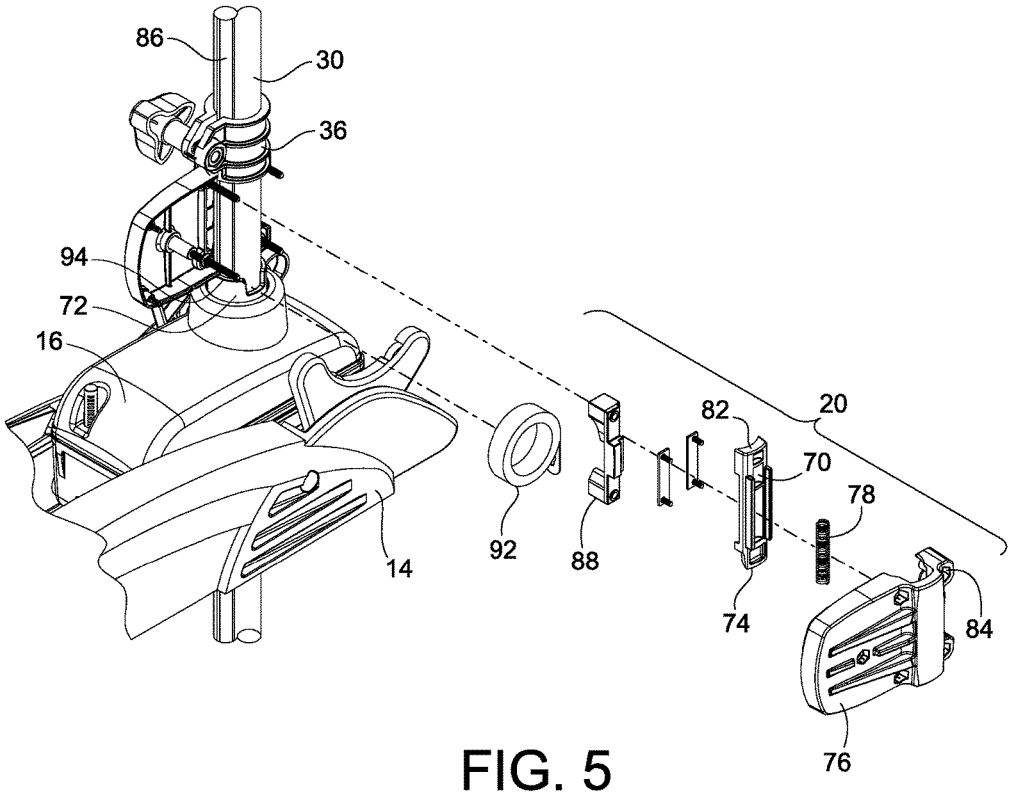
FIG. 5 is an exploded view of a lift assist device of the trolling motor system of FIG. 1.

Turning now to FIG. 5, the internal components of lift assist device 20 will be described in greater detail. Lift assist device 20 includes an outer housing 76 through which shaft 30 extends. Engagement member 72 is positioned within the outer housing 76. Lift assist device 20 also includes a spring 78 which acts upon engagement member 70. More specifically, spring 78 acts upon engagement member 70 to bias engaging end 74 such that it is recessed within outer housing 76 and thus not positioned within receiving gap 72 (See FIG. 4). However, engagement member 70 also includes an abutment end 82 which is biased out of an opening 84 in outer housing 76. As shaft assembly 18 is moved linearly along trim axis 40 in linear direction 46 as shown in FIG. 1, stop collar 36 which is fixedly mounted to shaft 30 will ultimately contact abutment end 82 and bias the same downwardly into outer housing 76 and against the force of spring 78. This causes engaging end 74 to then seat within receiving gap 72. Once engaging end 74 is seated in receiving gap 72, steering collar 66 and lift assist device 20 rotate about trim axis 40 in unison. It is also contemplated herein that other means for keying lift assist device 20 to steering collar 66 could be utilized, such as a frictional connection, mating pins and holes, etc. Indeed, any connection methodology which will rotationally fix lift assist device 20 relative to steering collar 66 may be utilized.

Shaft 30 also includes a channel 86 formed along the length thereof. A guide bar 88 is mounted within housing 76 such that a portion thereof projects into channel 86. A portion of guide bar 88 projects into and keys with channel 86 such that it does not limit or interfere with the capability of shaft assembly 18 to linearly move along trim axis 40 relative to lift assist device 20. However, this projection of guide bar 88 into channel 86 is such that any rotation of guide bar 88 about trim axis 40 with the remainder of lift assist device 20 will also cause shaft assembly 18 to rotate about trim axis 40. This interface between guide bar 88 and channel 86 is what causes the above-described transfer of steering inputs provided by steering collar 66 to lift assist device 20 to shaft 30 (and correspondingly shaft assembly 18). Guide bar 88 also serves the function of guiding a biasing element 92 out of an opening 94 in outer housing 76. As will be explained in greater detail below, biasing element 92 is responsible for providing the above-introduced upward lift assist force which reduces the overall required force input by a user to pull shaft assembly 18 upwardly in linear direction 48 along trim axis 40. An end of this coil spring 92 is connected to propeller unit 34.

Figure 6:
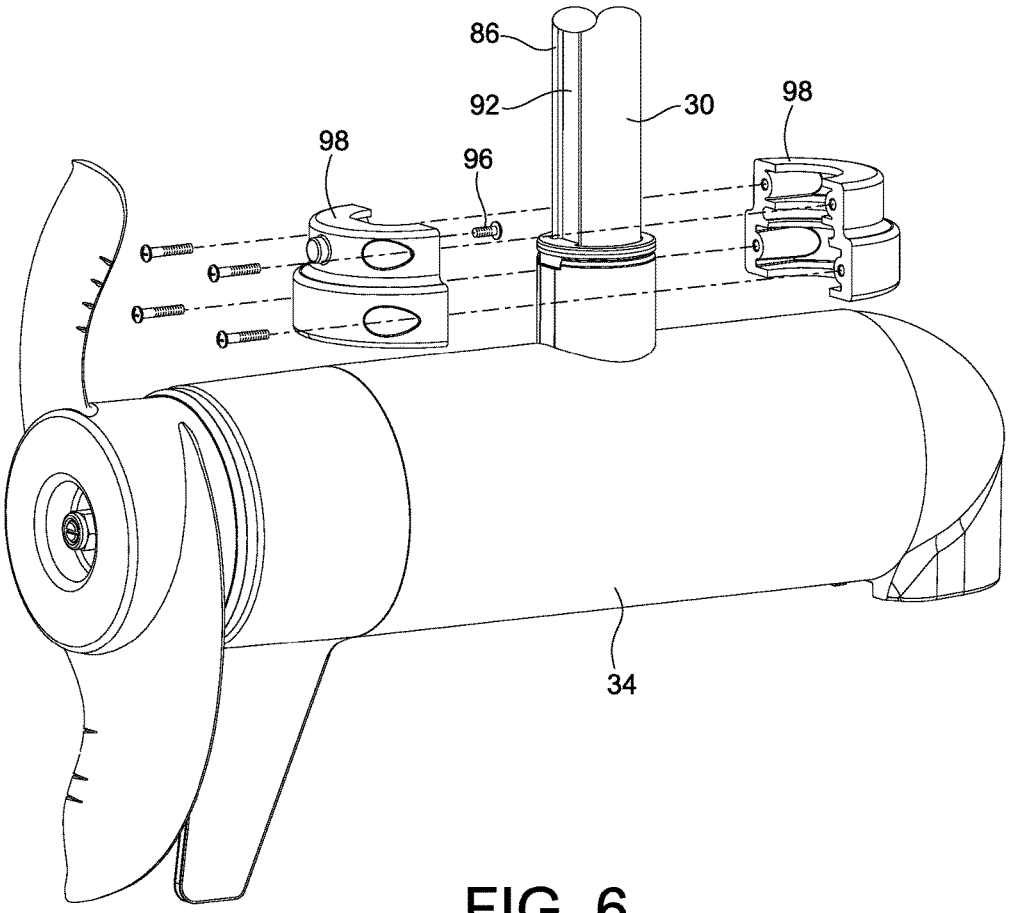
FIG. 6 is a perspective view of the lift assist device.

More specifically, and turning now to FIG. 6, an end 96 of coil spring 92 is mounted to a mounting collar 98 as shown in an exploded view in FIG. 6. This mounting collar is fixedly secured to propeller unit 34. As such, biasing element 92 exerts an upward pulling force against propeller unit 34, and thus the entirety of shaft assembly 18, in an effort to recoil back into outer housing 76 of lift assist device 20. This force is not enough to cause undesired linear movement of shaft assembly 18 along trim axis. It is enough force, however, to reduce the total force required by a user to move shaft assembly 18 upwardly along trim axis 40 in linear direction 48 (See FIG. 1). Such a configuration does advantageously allow larger propeller units 34 to be utilized without increasing the overall force required to transition a trolling motor incorporating such a larger propeller unit from the deployed position to the stowed position, or simply to adjust the trim thereof.

It will be recognized by those of skill in the art that although the illustrated embodiment utilizes a biasing element in the form of a coil spring, other biasing elements are contemplated. For example, a spring loaded drum with a cable attached thereto could be utilized instead of a coil spring. Further, an elastic member could be utilized instead of a coil spring. Those of skill in the art will recognize that such examples fall well within the general description of a biasing element.

Advantageously, the trolling motor system 10 described above incorporates a lift assist device 20 which reduces the overall force required by a user to move a shaft assembly 18 upwardly along a trim axis 40. It is also envisioned within the teachings of the present invention that lift assist device 20 may be a stand-alone device which may be incorporated into an existing trolling motor system. Indeed, lift assist device 20 may be readily incorporated into an existing trolling motor system simply by replacing the existing steering collar thereof with a steering collar that includes a receiving gap as described above, and sliding the lift assist device 20 along the shaft 30 to install the same.

Thereafter, one need simply to attach an end of the biasing element of lift assist device 20 to the propeller unit of such an existing trolling motor. In other words, the invention herein may be embodied as an entire system which includes a trolling motor with a lift assist device, or alternatively, may be embodied as a stand-alone with the assist device which may be retrofit onto an existing trolling motor system with minimal modification necessary. In either case, the instant invention has the overall advantage of reducing the overall force input required to adjust the trim of the trolling motor system, as well as to transition the trolling motor system from a deployed position to a stowed position.

Additionally, although lift assist device 20 is described herein as operably connected to the steering collar, the inventive concept here is not limited to this embodiment. Indeed, lift assist device 20 need not necessarily be coupled to the steering collar. Lift assist device 20 could attach elsewhere on a trolling motor and include a biasing element which attaches to the shaft assembly thereof to apply an upward force similar to that described above. Further, lift assist device 20 could be embodied as a biasing element which is itself integrated into a steering module or elsewhere on the trolling motor and attached at an end thereof to shaft assembly. Accordingly, the invention herein contemplates any configuration in which a supplementary upward force is applied to a steering assembly of a trolling motor to reduce the overall user force input required.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A trolling motor system, comprising:

a mount for mounting the trolling motor system to a watercraft;

a steering module mounted to the mount;

a shaft assembly including a shaft, a head unit mounted to a first end of the shaft, and a propeller unit mounted to a second end of the shaft, the shaft extending through a steering collar of the steering module, the shaft assembly linearly movable relative to the steering module along a trim axis;

a lift assist device, the lift assist device selectively coupled to the steering collar such that in coupled position, a rotational torque acting upon the steering collar is transferred to the lift assist device, and in a decoupled position the shaft assembly and lift assist device are rotatable relative to the steering collar; and wherein the lift assist device is operably coupled to the shaft assembly to exert an upward pulling force against the shaft assembly along the trim axis.

2. The trolling motor system of claim 1, wherein the shaft assembly includes a stop collar mounted along the shaft, and wherein the lift assist device includes an engagement member, the stop collar biasing an engaging end of the engagement member out of a housing of the lift assist device in the coupled position.

3. The trolling motor system of claim 2, wherein the engaging end of the engagement member seats in a receiving gap of the steering collar in the coupled position such that the rotational torque acting upon the steering collar is transferred to the engagement member of the lift assist device.

4. The trolling motor system of claim 3, wherein the lift assist device further comprises a guide bar, the guide bar including a projection.

5. The trolling motor system of claim 4, wherein the projection of the guide bar seats in a channel of the shaft of the shaft assembly.

6. The trolling motor system of claim 1, wherein the lift assist device includes a biasing element extendible from a housing of the lift assist device.

7. The trolling motor system of claim 6, wherein the biasing element is a coil spring.

8. The trolling motor system of claim 7, wherein an end of the coil spring is connected to the shaft assembly by a mounting collar.

9. The trolling motor system of claim 8, wherein the mounting collar is mounted to the propeller unit of the shaft assembly.

10. A lift assist device for a trolling motor, the lift assist device comprising:

a housing defining an opening configured for receipt of a shaft assembly of a trolling motor such that the shaft assembly is linearly movable within the opening along a trim axis;

a biasing element mounted within the housing, the biasing element extendible from the housing, the biasing element having an end thereof configured for connection to the shaft assembly;

wherein the biasing element is configured to exert an upward force upon the shaft assembly along the trim axis;

wherein the biasing element is a coil spring;

wherein the coil spring is uncoilable through an opening in the housing; and further comprising a guide bar for guiding the coil spring through the opening in the housing.

11. The lift assist device of claim 10, wherein the guide bar includes a projection, wherein the projection is configured to seat in a channel of the shaft assembly.

12. A lift assist device for a trolling motor, the lift assist device comprising:

a housing defining an opening configured for receipt of a shaft assembly of a trolling motor such that the shaft assembly is linearly movable within the opening along a trim axis;

a biasing element mounted within the housing, the biasing element extendible from the housing, the biasing element having an end thereof configured for connection to the shaft assembly;

wherein the biasing element is configured to exert an upward force upon the shaft assembly along the trim axis;

further comprising an engagement member contained within the housing;

further comprising a spring within the housing and acting upon the engagement member such that the spring biases an engaging end of the engagement member into a recessed position within the housing; and wherein the engaging end of the engagement member is configured to protrude from the housing against a biasing force of the spring and is arranged to extend into a receiving gap of a steering collar of the trolling motor.

* * * * *